United States Patent [19]

Harrold

[11] 4,151,912

[45] May 1, 1979

[54] STORAGE CONTAINER

[76] Inventor: John H. Harrold, 11338 Holmes Ave., Mira Loma, Calif. 91752

[21] Appl. No.: 885,357

[22] Filed: Mar. 13, 1978

[51] Int. Cl.[2] ..... B65D 85/24

[52] U.S. Cl. ..... 206/338; 206/372; 206/443; 206/523; 206/563

[58] Field of Search ..... 206/231, 303, 338, 372–379, 206/443, 472–473, 523, 557, 561–564; 220/339

[56] References Cited

U.S. PATENT DOCUMENTS

| | | | |
|---|---|---|---|
| 1,192,575 | 7/1916 | Selander | 206/379 |
| 1,946,808 | 2/1934 | Peirce | 206/231 |
| 2,792,935 | 5/1957 | Rocchetti | 206/379 |
| 3,410,391 | 11/1968 | Kanter | 206/379 X |
| 3,540,576 | 11/1970 | Pierce et al. | 206/303 |

FOREIGN PATENT DOCUMENTS

| | | | |
|---|---|---|---|
| 1329755 | 5/1973 | France | 206/375 |

*Primary Examiner*—William Price

*Assistant Examiner*—Joseph M. Moy

*Attorney, Agent, or Firm*—Harvey C. Nienow

[57] ABSTRACT

A storage container for associated or related articles such as nuts and bolts wherein there is a myriad of different sizes and shapes for each of the different types of related articles. It comprises a main body having a continuous side wall and open opposite ends, each end having a separate and independent cover. A first partition wall is provided within the body and has a plurality of slots for receiving bolts of a given diameter and thread configuration but of different lengths. A second partition wall is also provided in the main body, and has a plurality of trays for holding the nuts, such trays being in number equal to the number of slots in the first partition wall and arranged parallel and adjacent thereto so that mating nuts and bolts are arranged in juxtaposition. Thus the proper bolt and corresponding nut can be extracted from the container through said opposite ends of said main body but from corresponding locations therein.

6 Claims, 5 Drawing Figures

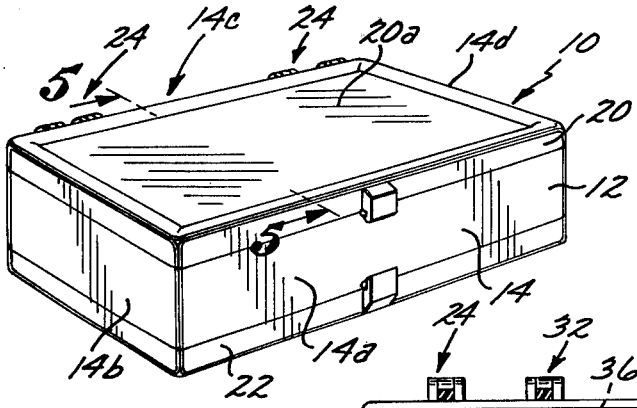
FIG. 1
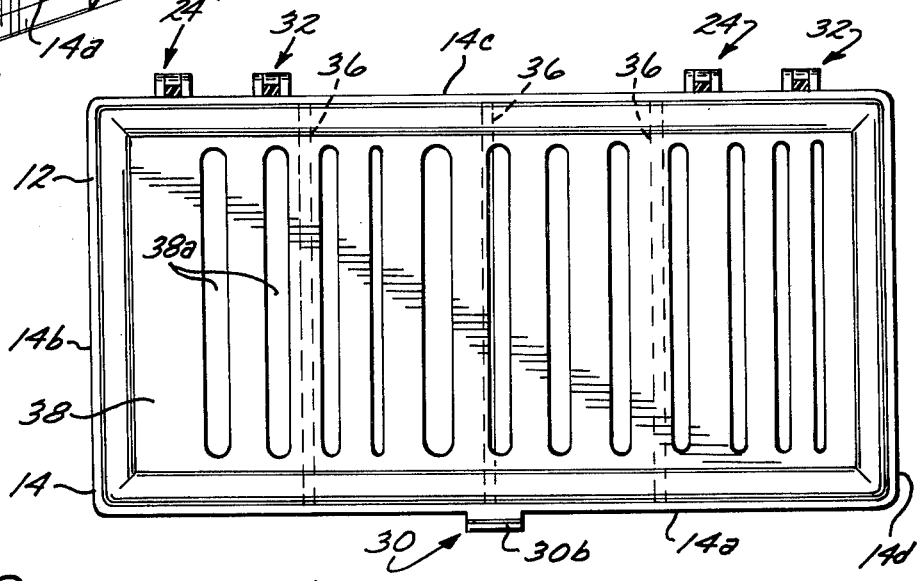
FIG. 3
FIG. 2
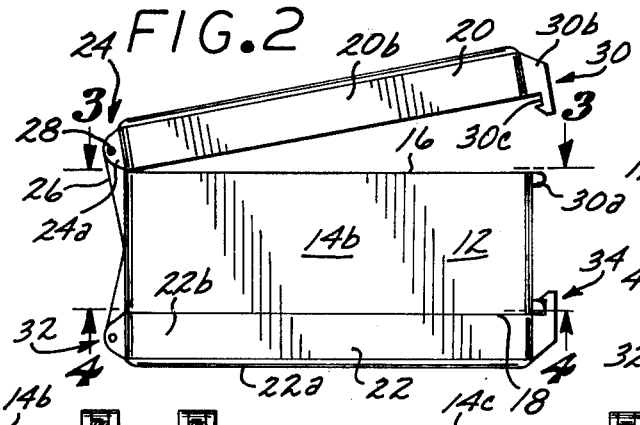
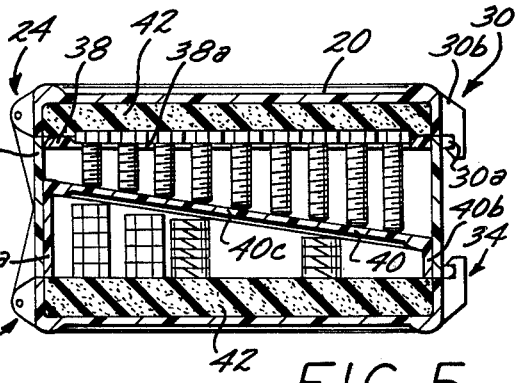
FIG. 5
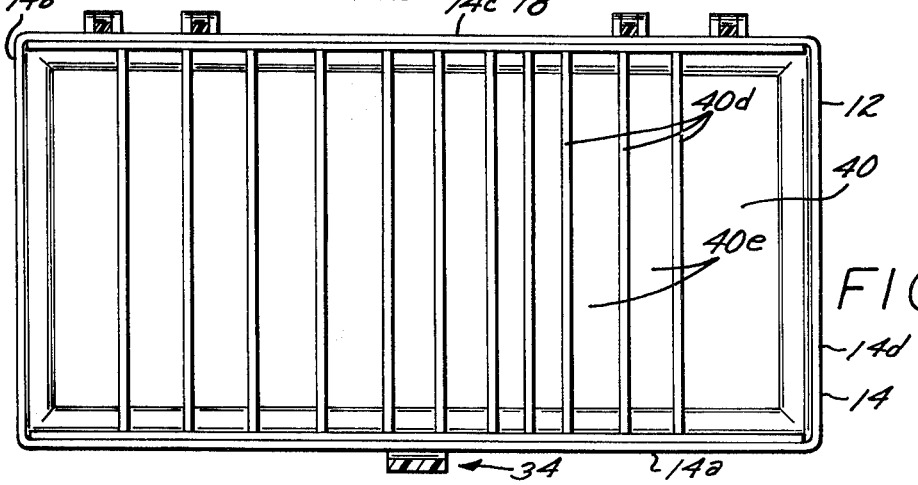
FIG. 4

STORAGE CONTAINER

The present invention relates generally to storage containers, and more particularly to containers for related articles having different but related characteristics.

It is frequently necessary, particularly for maintenance and repair personnel, to have a great many different shapes and sizes of articles such as nuts and bolts for quickly and effectively reparing machinery and the like. Other skilled craftsmen also must maintain a supply of bolts of different bolt shank diameters, thread configuration and length, as well as mating fastening nuts.

Heretofore, such articles having different characteristics and sizes have been kept in individual boxes, or were mixed together in a single container. In either event, it was extremely difficult and timeconsuming to locate the desired nut and bolt such that a substitute size was often used, resulting in faulty repair of the particular structure.

In view of the foregoing, is an object of this invention to provide a storage container for related articles having different but related characteristics wherein such articles are readily accessible.

A further object of the present invention is to provide a storage container as characterized above which enables the various articles to be stored in predetermined locations within the container so as to be readily identifiable and accessible as to size, shape or other characteristics.

A still further object of the present invention is to provide a storage container as characterized above wherein related articles such as fastening bolts and nuts therefore are stored in close proximity but in a predetermined manner so as to make identifying the related articles simple and effortless.

An even further object of the present invention is to provide a storage container as characterized above which is formed with several lids or covers affording access to different portions of the container.

Another further object of the present invention is to provide a storage container as characterized above which is simple and inexpensive to manufacture and which is rugged and dependable in operation.

The novel features which I consider characteristic of my invention are set forth with particularity in the appended Claims. The invention itself, however, both as to its organization and mode of operation, together with additional objects and advantages thereof, will best be understood from the following description of specific embodiments when read in connection with the accompanying drawings, in which:

FIG. 1 is a perspective view of a storage container according to the present invention;

FIG. 2 is a side elevational view thereof, showing one of the covers of the container in partially opened position;

FIG. 3 is a top plan view of the main body of the container, taken substantially along line 3—3 of FIG. 2;

FIG. 4 is a bottom plan view of the main body of the container, taken substantially along line 4—4 of FIG. 2, and FIG. 5 is a transverse sectional view of the container, taken substantially along line 5—5 of FIG. 1.

Like reference characters indicated corresponding parts throughout the several views of the drawing.

Referring to FIG. 1 of the drawings, there is shown therein a storage container 10 according to the present invention. Such container comprises a main body 12 having a continuous side wall 14 as provided by relatively flat walls 14*a*, 14*b*, 14*c* and 14*d*. Such continuous side wall 14 affords main body 12 with open opposite ends 16 and 18.

A cover is provided for each of said open opposite ends as shown at 20 and 22. Cover 20 is provided with an intermediate or central portion 20*a* and a continuous depending lip or ledge 20*b* which conforms to the general shape of configuration of main body 12. In like fashion, cover 22 is provided with an intermediate portion 22*a* and a lip or ledge 22*b* which conforms to the shape of main body 12 about the open end 18.

The cover 20 is provided with hinge means 24 which may take substantially any form but is shown in the drawings as comprising one or more tabs 24*a* which cooperate with an extension 26 on main body 12 to receive a pivot pin 28. In this fashion, the various hinge means 24 enable cover 20 to be opened and closed on the open end 16 of main body 12.

Suitable locking or latching means 30 comprising a rib 30*a* secured to main body 12 and a latch member 30*b* secured to or formed with cover 20 is provided for latching cover 20 in its closed position. A cut out 30*c* is provided on latch member 30*b* for engagement with the rib 30*a* when cover 20 is in it's closed position.

In like manner, there is provided for cover 22 hinge means 32 constructed in a manner indentical with the above described hinge means 24. Also, latch or locking means 34 is provided for cover 22, identical in contruction with the aforedescribed latching or locking means 30 of cover 20.

As shown most particularly in FIG. 3 of the drawings, three supports 36 are provided across the main body 12. A first partition wall 38 formed with a plurality of storage slots 38*a* for receiving a plurality of bolts in the manner shown in FIG. 5 of the drawings, is provided within the main body 12 on the ribs 36. The slots 38*a* are of predetermined and individual widths to accommodate the shank or body of fastening bolts of predetermined size. That is, each of the slots 38*a* is particularized to receive threaded bolts of a prescribed shank diameter. Due to the fact that there are different styles or shapes of fastening bolts, such as stove bolts, carriage bolts, machine machine bolts and the like, the first partition wall 38 is formed with some identical slots 38*a* to provide different locations for bolts of different sytles but of the same shank diameter.

A second partition wall 40 is provided within the main body 12, having at least two side walls 40*a* and 40*b* as well as an angularity disposed bottom wall 40*c*.

It is contemplated that the second partition wall 40, as well as the first partition wall 38, may be removable from the main body 12 of the storage container to facilitate manufacture and assembly of the entire unit. In this regard, interlocking protuberances and detents (not shown in detail) may be employed for enabling the second partition wall 40 to be snapped into the main body 12 in the proper location.

As shown most particularly is FIG. 4 of the drawings, second partition wall 40 is formed with a series of wall 40*d* which cause partition wall 40, in cooperation with main body 12 to provide a series of receptacles or bins 40*e*. Such bins are for receiving and retaining fastening nuts for cooperation with the aforementioned fastening bolts, but in a manner to effectuate association of the proper bolt and nut. That is, since bolts and nuts differ not only as to style or configuration and diameter, but also as to thread size or shape (as for instance, national course and national fine threads) it is desirable to provide a close association between the bolt and nut which are made for each other. In this regard, there are as many bins or receptacles 40*e* in the second partition wall 40 as there are slots 38*a* in the first partition wall 38. Further, such bins and slots are juxtaposed respectively, so that the related fastening bolt and nut are immediately adjacent each other to enable an individual to always make the proper selection and combination. That is, merely by inverting the container 10, the individual can always select the proper mating or related article by virtue of making a slection from the corresponding slot or bin, as the case may be.

The bottom wall 40*c* of the second partition wall 40 is disposed at an angle, as shown in FIG. 5 of the drawings, to accommodate fastening bolts which are distinguishable only by a difference in length. Thus, within the small interior space of the container 10, it is possible to accommodate fastening bolts of various lengths.

To retain the various articles in proper position within the container, it is contemplated that a pad of resilient material such as rubber, plastic or the like as shown at 42 can be provided in each of the covers 20 and 22. The resilient material in the cover 20 is urged against the heads of the bolts in the first partition wall 38 and the resilient material 42 in cover 22 is urged against the walls 40*d* of the second partition wall 40.

It is thus seen that the present invention provides a storage container whereby many different related articles having different but related characteristics as with respect to size and shape can be conveniently and readily stored so as to permit an individual to easily and readily find not only the desired article but also an article which is related thereto.

Although I've shown and described certain specific embodiments of my invention, I am well aware that many modifications thereof are possible. The subject invention, therefore, is not to be restricted except insofar as is necessitated by the prior art and by the spirit of the appended Claims.

I claim:

1. A storage container for related articles having different but related characteristics comprising in combination, a main body having a continuous side wall and open opposite ends, a cover for each of said open ends of said body, a first partition wall fixed to the side wall of said main body and formed with a plurality of slots to receive and retain a first set of articles of different sizes, a second partition wall fixed to said main body side wall adjacent said first partition wall and formed with a plurality of trays aligned with said slots to receive and retain a second set of articles of different sizes having characteristics which are predetermined characteristics of said first set, said slots and trays being arranged to receive articles from said first and second sets respectively in adjacent relation according to said related characteristics, but only through a separate one of the open ends of said main body by opening the corresponding cover therefor.

2. A storage container for related articles having different but related characteristics according to claim 1, wherein said slots in said first partition wall are adapted to receive fastening bolts of different body sizes and wherein said trays are for receiving nuts for said bolts arranged within said main body such that mating bolts and nuts are juxtaposed but accessible through different open ends of said body.

3. A storage container for related articles having different but related characteristics according to claim 2, wherein said trays and slots are elongated and extend substantially parallel to each other.

4. A storage container for related articles having different but related characteristics according to claim 3, wherein said covers are hingedly connected to said main body.

5. A storage container for related articles having different but related characteristics according to claim 4, wherein flexible material is fixed to each of said covers to engage said bolts and nuts respectively when in closed position on said main body.

6. A storage container for related articles having different but related characteristics according to claim 5, wherein said second partition wall is formed with a bottom wall for said trays, said bottom wall being disposed in said body at an angle to said first partition wall to thereby provide a space therebetween of varying dimension to enable said first partition wall to receive bolts of different lengths without interfering with said second partition wall.

* * * * *